US005971379A

United States Patent [19]

Leon, Jr.

[11] Patent Number: 5,971,379

[45] Date of Patent: Oct. 26, 1999

[54] ADJUSTABLE MAGNETIC JIG

[76] Inventor: Raymond Leon, Jr., 51-935 Sunset Dr., Coachella, Calif. 92236

[21] Appl. No.: 08/917,986

[22] Filed: Aug. 27, 1997

[51] Int. Cl.[6] ..... B25B 11/00; B25B 1/20

[52] U.S. Cl. ..... 269/8; 269/37; 269/41; 269/45; 228/212

[58] Field of Search ..... 269/8, 37, 41, 269/45; 228/212

[56] References Cited

U.S. PATENT DOCUMENTS

| | | | |
|---|---|---|---|
| 1,336,928 | 4/1920 | Simmons | 269/8 |
| 2,884,698 | 5/1959 | Würsch | 269/8 |
| 3,394,389 | 7/1968 | Amir | 269/45 |
| 3,456,941 | 7/1969 | Beskow | 269/41 |

*Primary Examiner*—Patrick Ryan
*Assistant Examiner*—Jeffrey T. Knapp
*Attorney, Agent, or Firm*—Timothy Thut Tyson; Ted Masters; Freilich, Hornbaker & Rosen

[57] ABSTRACT

An adjustable magnetic jig 20 includes a first magnetic holder 22, and a second magnetic holder 26. A pivoting joint 30 connects the first 22 and second 26 magnetic holders, so that the angle A between the holders may be selectively adjusted. Pivoting joint 30 is also selectively lockable so that angle A can be fixedly maintained. Jig 20 is particularly useful in holding magnetic workpieces 500 in a desired physical relationship so that the two workpieces 500 can be welded together.

10 Claims, 9 Drawing Sheets

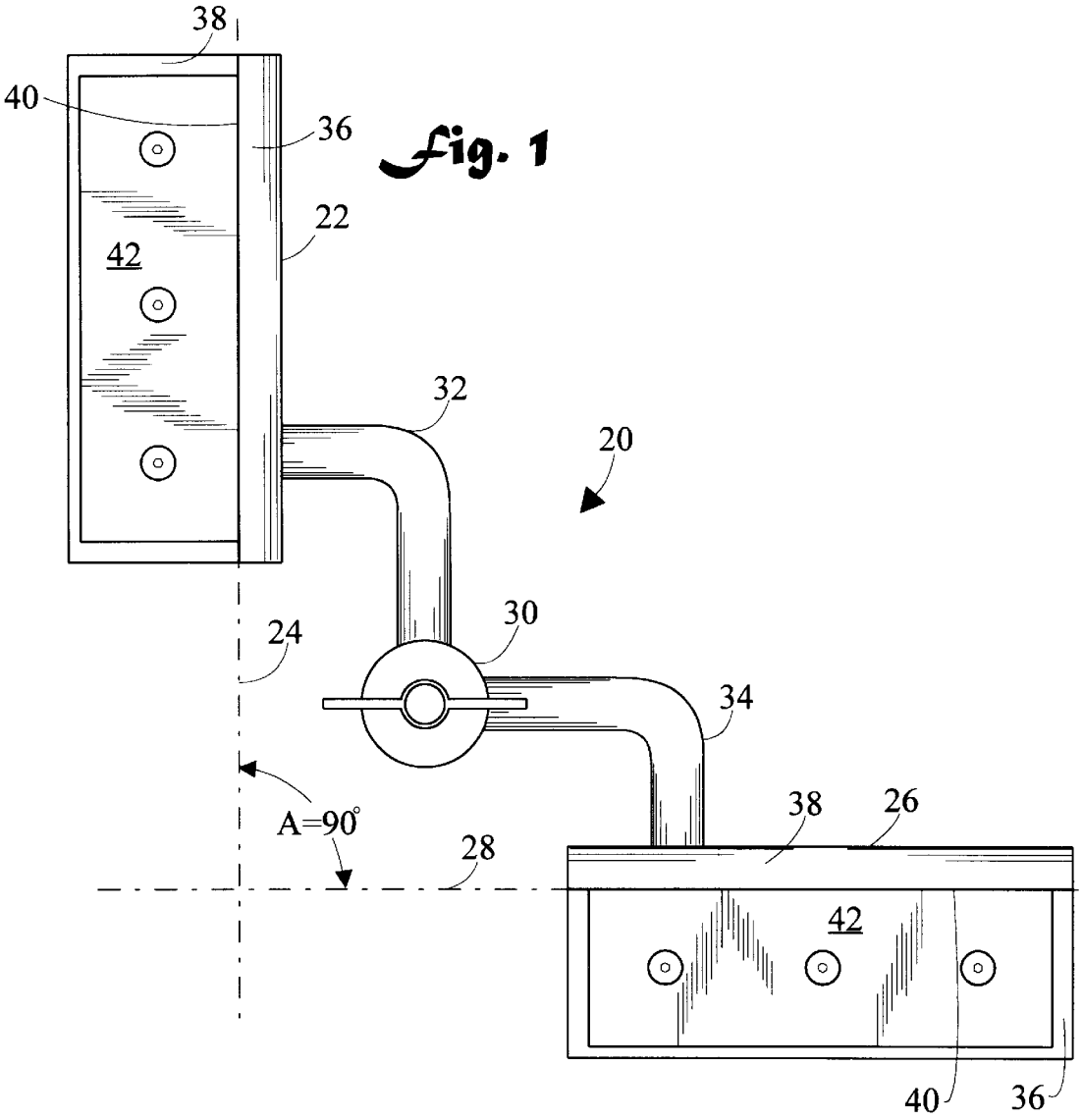
Fig. 1
Fig. 2
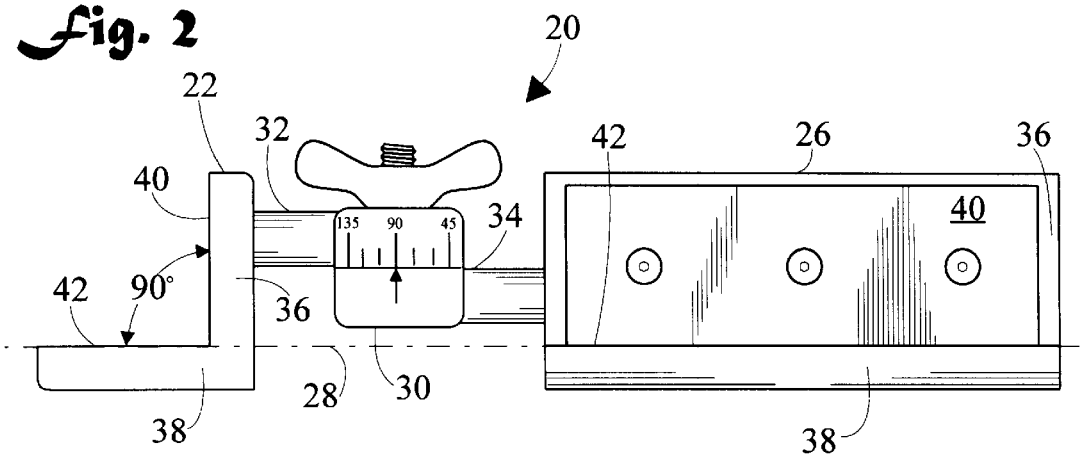

Fig. 3
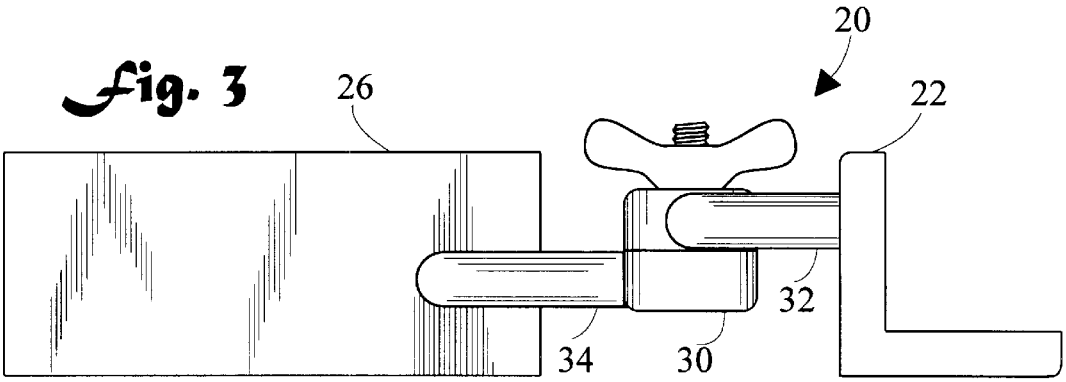
Fig. 4
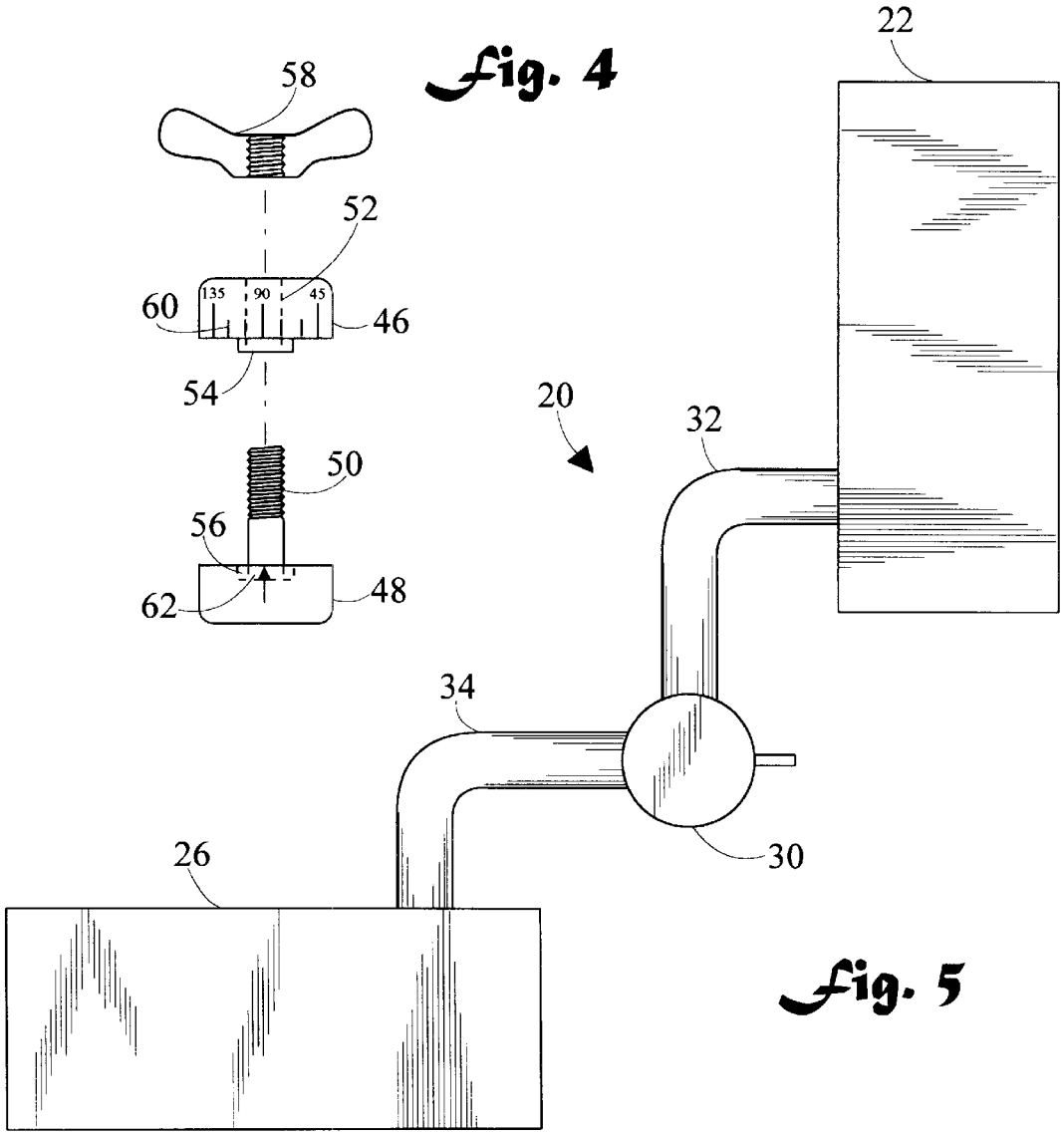
Fig. 5

22
20
26
24
30
28
A=45°

ADJUSTABLE MAGNETIC JIG

TECHNICAL FIELD

The present invention pertains to workpiece holders also known as jigs, and more particularly to holders which are used during the process of welding.

BACKGROUND ART

Workpiece holders or jigs are well known in the art. These devices are utilized to hold one or more items in a desired position while a manufacturing process is performed. An apparatus for holding two metallic components in a fixed abutting relationship for welding is typical of this technology. In a specialized category of workpiece holders, the item(s) are held in place by magnet force. For example, U.S. Pat. No. 2,443,582 shows a work holder of the kind used for holding component metal parts in place while they are being connected together, and is especially useful for welding. The device includes a plurality of electromagnets mounted on a frame. The electromagnets are arranged so as to generally correspond with the shape of the work structure to be produced. U.S. Pat. No. 2,676,504 defines a magnetic face plate for either permanent or detachable mounting on the jaws of a vice. The device also includes suction means for holding objects on nonmagnetic material to the face plate. U.S. Pat. No. 3,210,068 depicts a magnetic spacing tool for establishing a uniform gap of a desired width between two objects to be welded together. The spacing tool includes an elongated spacing member or plate having a cutout which forms a handle portion. The thickness of the spacing tool is equal to the desired spacing to be established between the adjacent portions of the workpieces. U.S. Pat. No. 3,491,995 disclosed an work holding apparatus for tack welding, comprising a mobile welding jig yieldably supported by castor wheels for movement to a desired location on a steel plate straddling a steel beam to which the plate is to be tack welded. Magnetic gripping devices anchor the jig frame to the steel plate while retracting the castor wheels so that the beam and plate are clamped together when a fluid power operated piston engages the beam. U.S. Pat. No. 4,492,367 comprises a magnetic holding apparatus for holding an object, such as a furnace or kiln block, in a predetermined position relative to an external metal member, such as the metallic shell of furnace or kiln. The apparatus includes a foot assembly which is adjustably supported on a rod member, which is in turn supported by the lower side of a magnet. The upper side of the magnet is removably magnetically affixed to the metallic shell so as to secure the apparatus thereto, thus enabling the foot assembly to hold the object against the magnetic shell. U.S. Pat. No. 4,524,959 consists of a holder of pipes or pipe joints for welding, where one of the pipes or pipe joint is held by three pipe abutting members mounted in angularly spaced relation on a common holder with the position of the pipe abutting members being adjustable by a screw bar.

The aforementioned devices require that the workpiece be precisely clamped or otherwise secured to the jig. This is often a time consuming process, requiring numerous clamping, unclamping, adjusting, and reclamping steps, to ensure that the workpiece is properly positioned.

A Welder's Vice Set manufactured by Bessey, Germany includes a cast iron base having two jaws in a fixed 90° relationship, and a moveable jaw which clamps the workpieces against the fixed jaws. A magnetic welding fixture Model AD-1307 manufactured by MAGNETOOL INC., 505 Elmwood, Troy, Mich. 48083-2755, adjusts and locks securely at any angle from 45° to 90°. A magnetic welding fixture MAC 9 manufactured by BUNTING Magnetics Co., 500 S. Spencer Avenue, Box 468, Newton, Kans. 67114-0468 illustrates a heavy-duty variable magnetic clamp which may be set at any angle from 45° to 90°, and has angles marked in 15° increments. Model MAC 2 comprises an adjustable magnetic clamp which is adjustable from 25° to 280°.

DISCLOSURE OF INVENTION

The present invention is directed to a simplified jig for holding workpieces in a desired position while a manufacturing process such as welding is performed. The present invention overcomes the time consuming clamping, unclamping, adjusting, and reclamping steps of the prior by providing a magnetic retaining means which allows two workpieces to be easily and rapidly placed in a desired mutual relationship. The present invention employs two magnetic workpiece holders each having perpendicular surfaces. The workpiece is installed in the holder so that it abuts both of the planar surfaces and is thereby exactly aligned with the longitudinal axis of the holder.

In accordance with a preferred embodiment of the invention, an adjustable magnetic jig includes a first magnetic holder having a first longitudinal axis, and a second magnetic holder having a second longitudinal axis. The second longitudinal axis is coplanar with and intersects the first longitudinal axis to form an angle therebetween. A pivoting joint connects the first and second magnetic holders, so that the angle may be selectively adjusted.

In accordance with an important aspect of the invention, the first and second magnetic holders each further include at least one magnet.

In accordance with an important aspect of the invention, the first and second magnetic holders each further include first and second walls which intersect at a substantially 90° angle forming first and second substantially perpendicular planar surfaces, the intersection of the surfaces defining the first longitudinal axis for the first magnetic holder, and defining the second longitudinal axis for the second magnetic holder.

In accordance with another important aspect of the invention, a magnetic workpiece is placed in the first magnetic holder so that the workpiece abuts both the first planar surface and the second planar surface.

In accordance with another important feature of the invention, the pivoting joint further includes first and second rotary members, the first rotary member is connected to the first magnetic holder, and the second rotary member is connected to the second magnetic holder, the first and second rotary members being rotatable with respect to each other.

In accordance with an aspect of the invention, the first and second rotary members can be angularly positioned so that the angle is between substantially 45° and 180°.

In accordance with a feature of the invention, the first rotary member includes one of angular indicia and an index mark, and the second rotary member includes the other of angular indicia and an index mark.

In accordance with another preferred embodiment of the invention, the pivoting joint is selectively lockable so that the angle can be fixedly maintained.

In accordance with another important feature of the invention, when the angle is set to 180°, pipe workpieces can be rotated as a welding operation proceeds, with the welding apparatus remaining stationary. This is in contrast to conventional welding jigs wherein the welding apparatus must be rotated around the welded joint.

Other features and advantages of the present invention will become apparent from the following detailed description, taken in conjunction with the accompanying drawings, which illustrate, by way of example, the principles of the invention.

BRIEF DESCRIPTION OF DRAWINGS

FIG. 1 is a top plan view of an adjustable magnetic jig in a 90° position in accordance with the present invention;

FIG. 2 is a front elevation view of the jig;

FIG. 3 is a rear elevation view of the jig;

FIG. 4 is an exploded view of a pivoting joint;

FIG. 5 is a bottom plan view of the jig;

MODES FOR CARRYING OUT THE INVENTION

Figure 6:
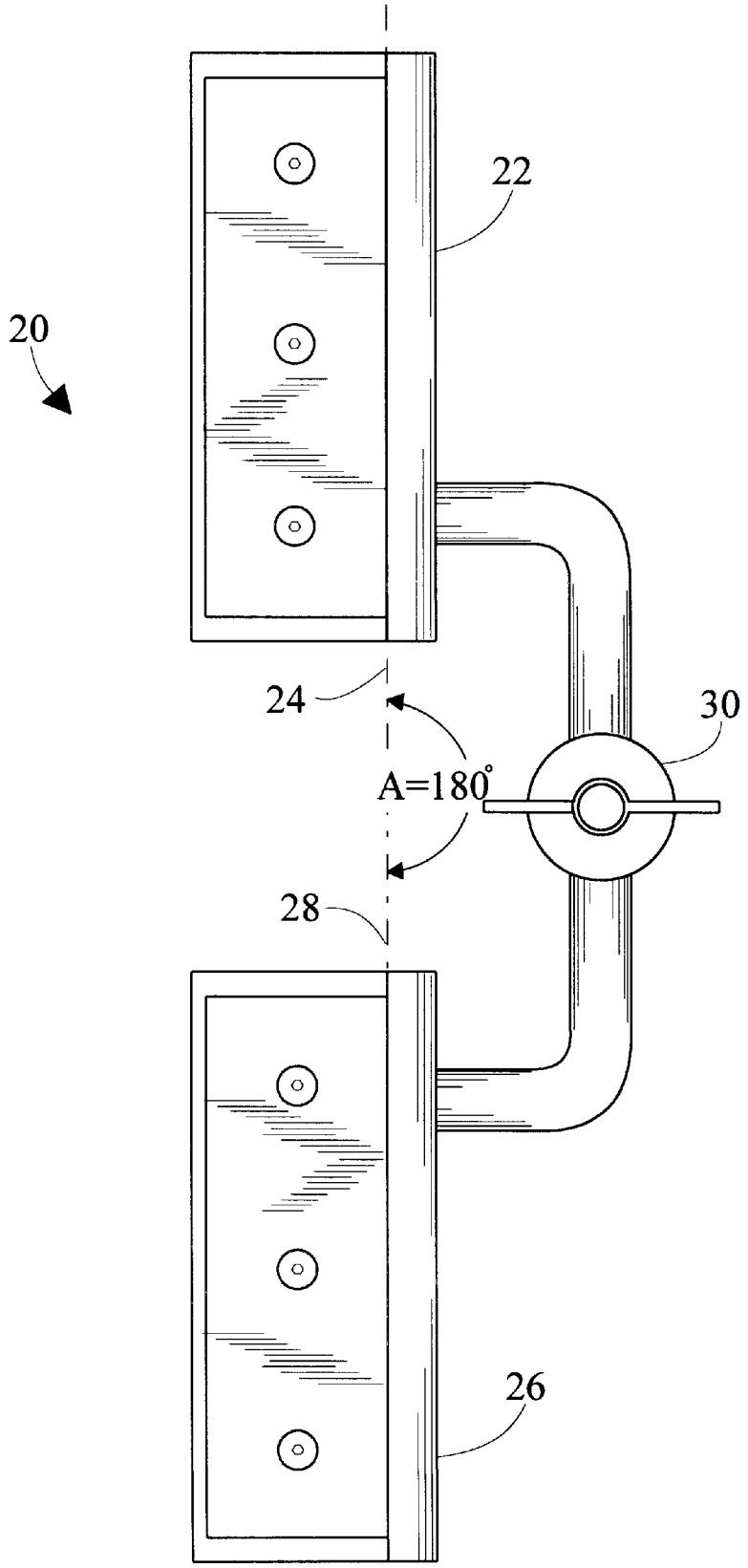
FIG. 6 is a top plan view of the jig in a 180° position.

Referring initially to FIGS. 1 and 2, there are illustrated top plan and front elevation views respectively of an adjustable magnetic jig in accordance with the present invention, generally designated as 20. Jig 20 includes a first magnetic holder 22 having a first longitudinal axis 24, and a second magnetic holder 26 having a second longitudinal axis 28. First magnetic holder 22 and second magnetic holder 26 each include at least one magnet which magnetically grips an inserted workpiece made of a magnetic material (refer also to FIG. 10). In a preferred embodiment the magnet is a permanent magnet, however, an electromagnet could also be utilized. Second longitudinal axis 28 is coplanar with and intersects first longitudinal axis 24 to form an angle A therebetween.

A pivoting joint 30 connects first and second magnetic holders 22 and 26 so that angle A may be selectively adjusted. Pivoting joint 30 is connected to first magnetic holder 22 by first elbow 32, and to second magnetic holder 26 by second elbow 34.

First 22 and second 26 magnetic holders each further include first 36 and second 38 walls which intersect at a substantially 90° angle forming first 40 and second 42 substantially perpendicular planar surfaces. The intersection of surfaces 40 and 42 defines first longitudinal axis 24 for first magnetic holder 22, and defines second longitudinal axis 28 for second magnetic holder 26. First 40 and second 42 surfaces are useful in that a workpiece 500 (refer to FIGS. 10 and 11) can be positioned so that it abuts both surfaces and is thereby held parallel with either the first 24 or second 28 longitudinal axes.

FIG. 3 is a rear elevation view of the jig 20.

FIG. 4 is an exploded view of pivoting joint 30. Pivoting joint 30 includes first 46 and second 48 rotary members. First rotary member 46 is connected to first magnetic holder 22 by first elbow 32, and said second rotary member 48 is connected to second magnetic holder 26 by second elbow 34. First 46 and second 48 rotary members are rotatable with respect to each other. Second rotary member 48 has a bolt 50 which passes through hole 52 in first rotary member 46. First rotary member 46 includes a circular plateau 54 which engages a circular recess 56 in second rotary member 48. A wing nut 58 engages bolt 50 and is used to force first rotary member 46 and second rotary member 48 tightly together so that pivoting joint 30 can be selectively locked and angle A fixedly maintained. First 46 and second 48 rotary members can be angularly positioned so that angle A can be adjusted anywhere between substantially 45° and 180°. In a preferred embodiment, first rotary member 46 includes one of angular indicia 60 and an index mark 62, and second rotary member 48 includes the other of angular indicia 60 and an index mark 62. In this manner, a user of jig 20 can easily adjust angle A to a desired value. In an alternative embodiment, the angular indicia does not represent angle A, but rather the complement of angle A.

FIG. 5 is a bottom plan view of jig 20.

FIG. 6 is a top plan view of jig 20 in a 180° position. First magnetic holder 22 and second magnetic holder 26 have been adjusted via pivoting joint 30 so that first longitudinal axis 24 intersects and is aligned with second longitudinal axis 28 thereby forming an angle A of 180°.

Figure 7:
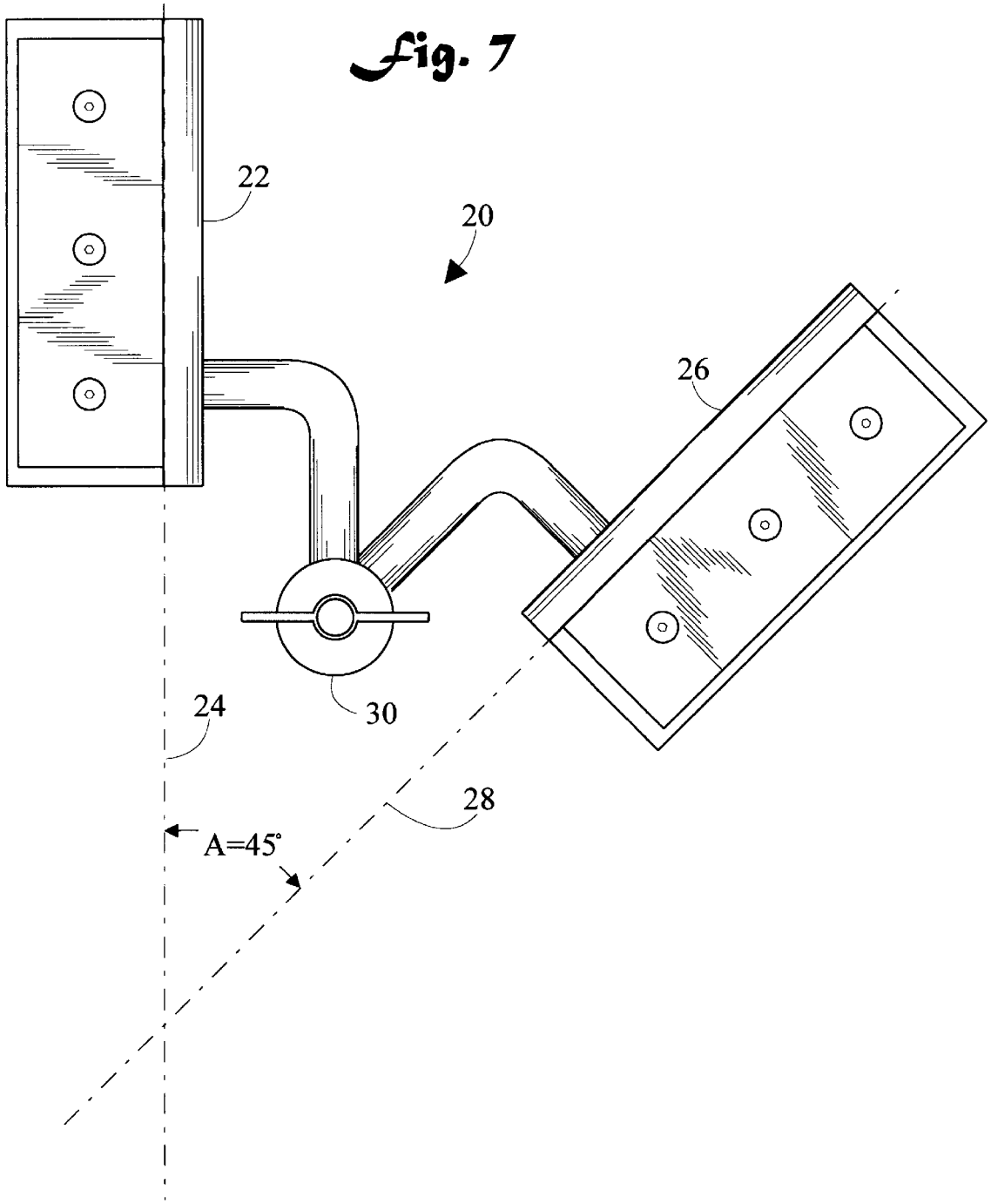
FIG. 7 is a top plan view of the jig in a 45° position.

FIG. 7 is a top plan view of jig 20 in a 45° position. First magnetic holder 22 and second magnetic holder 26 have been adjusted via pivoting joint 30 so that first longitudinal axis 24 intersects second longitudinal axis 28 thereby forming an angle A of 45°.

Figure 8:
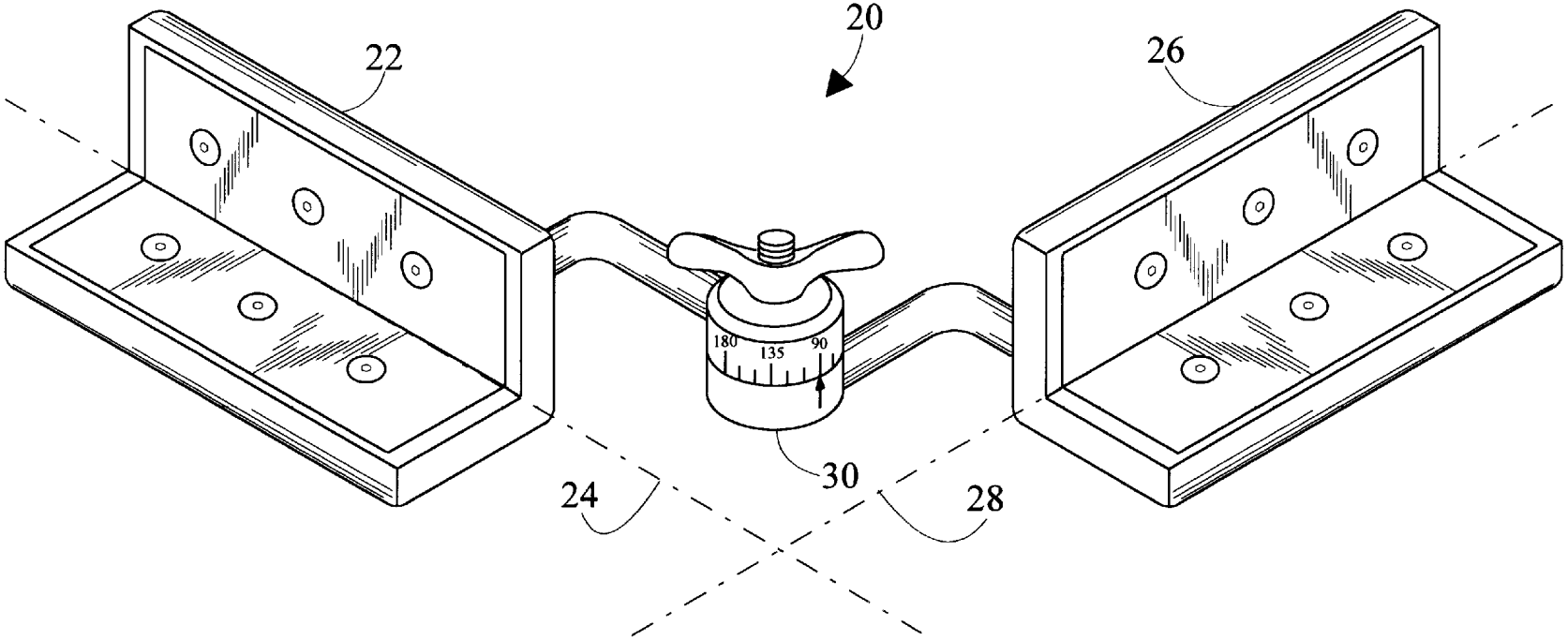
FIG. 8 is a perspective view of the jig in the 90° position.

FIG. 8 is a perspective view of the jig 20 in the 90° position showing the intersection of first longitudinal axis 24 with second longitudinal axis 28.

Figure 9:
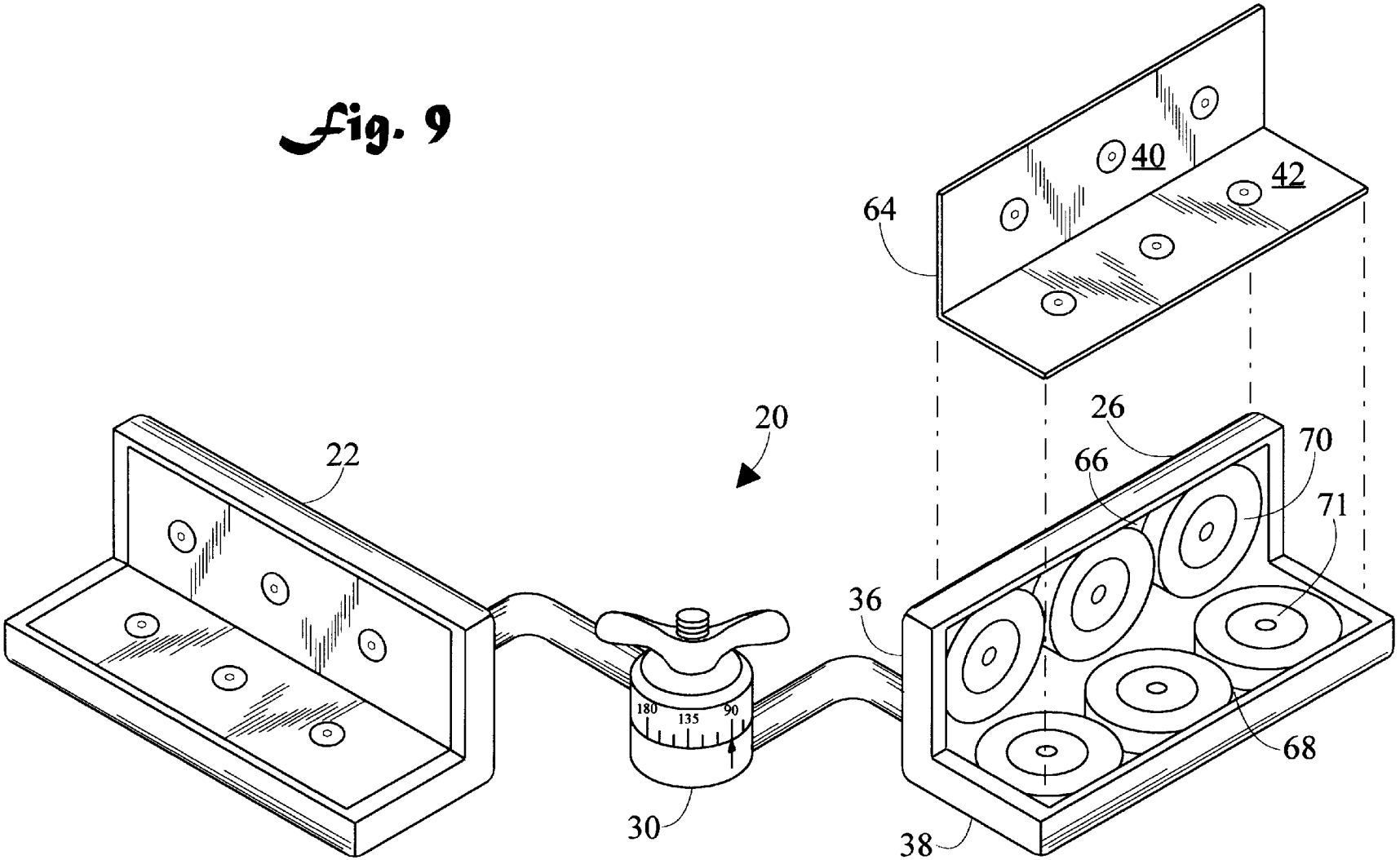
FIG. 9 is a partially exploded perspective view of the jig showing a removable cover removed from the second magnetic holder.

FIG. 9 is a partially exploded perspective view of jig 20 showing a removable cover 64 removed from second magnetic holder 26. First wall 36 further includes a first magnet-receiving cavity 66 and said second wall 38 further includes a second magnet-receiving cavity 68. In a preferred embodiment three permanent magnets 70 are disposed within each of first magnet-receiving cavity 66 and second magnet-receiving cavity 68. Permanent magnets 70 are donut-shaped, however any other convenient shape such as bar magnets could also be used. An aluminum keeper 71 holds magnets 70 in place. Removable cover 64 covers both said first and second magnet receiving cavities, and forms first 40 and second 42 planar surfaces upon which the workpiece magnetically rests.

Figure 10:
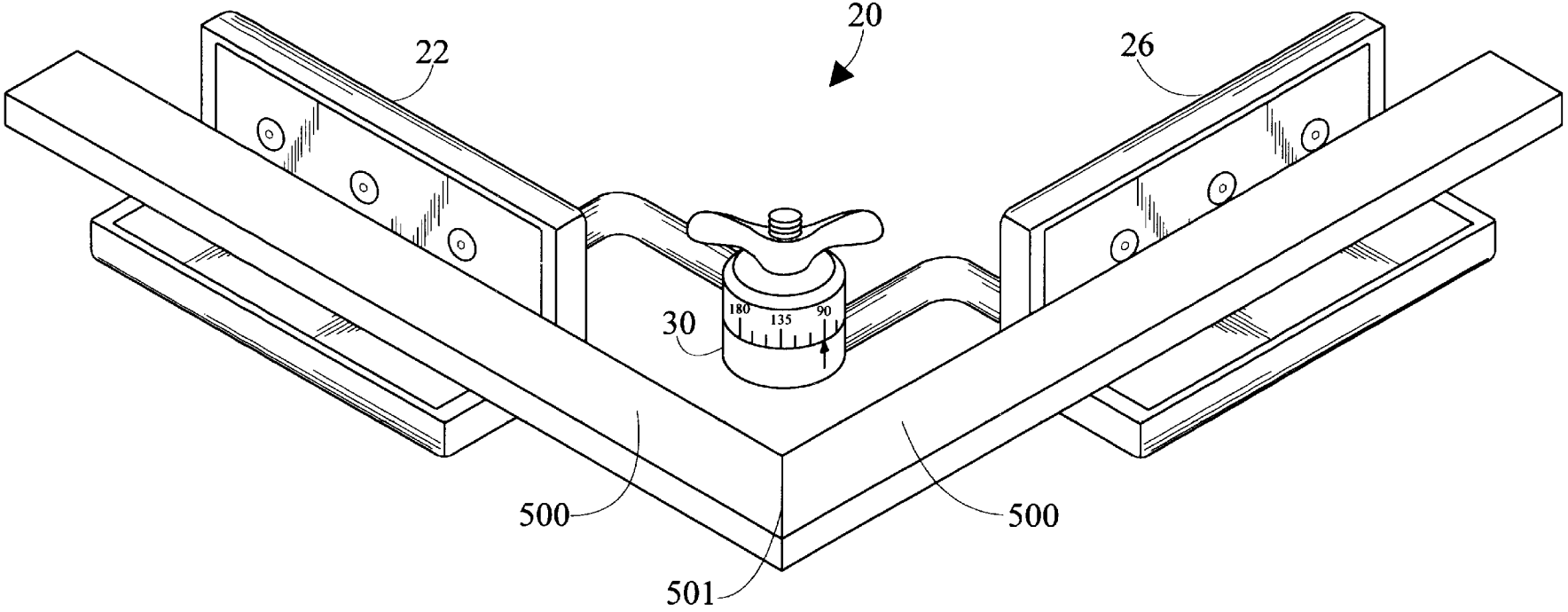
FIG. 10 is a perspective view of the jig being used to hold two bars in a 90° relationship.

FIG. 10 is a perspective view of jig 20 being used to hold two workpiece bars 500 in a 90° relationship. Bars 500 have been mitered to form a mating pre-weld joint 501.

Figure 11:
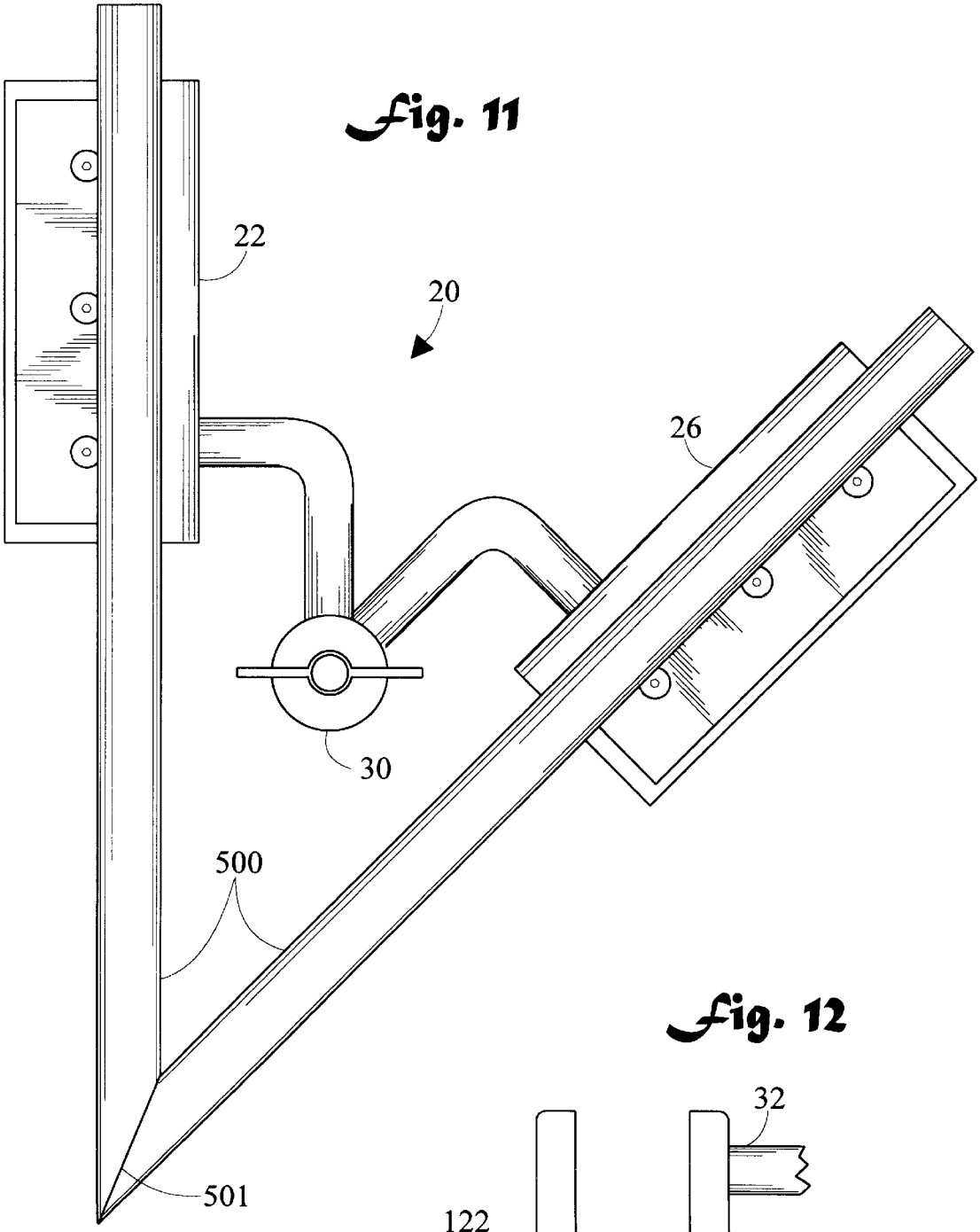
FIG. 11 is a top plan view of the jig being used to hold two pipes in a 45° relationship.

FIG. 11 is a top plan view of jig 20 being used to hold two pipes 502 in a 45° relationship. Pipes 502 have been mitered to form a mating pre-weld joint 501.

Figure 12:
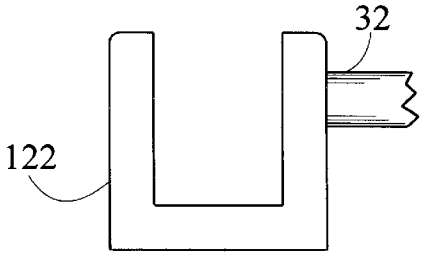
FIG. 12 is an end view of a second embodiment of a magnetic holder.

FIG. 12 is an end view of a second embodiment of a magnetic holder 122, in which the magnetic holder 122 is substantially channel-shaped.

Figure 13:
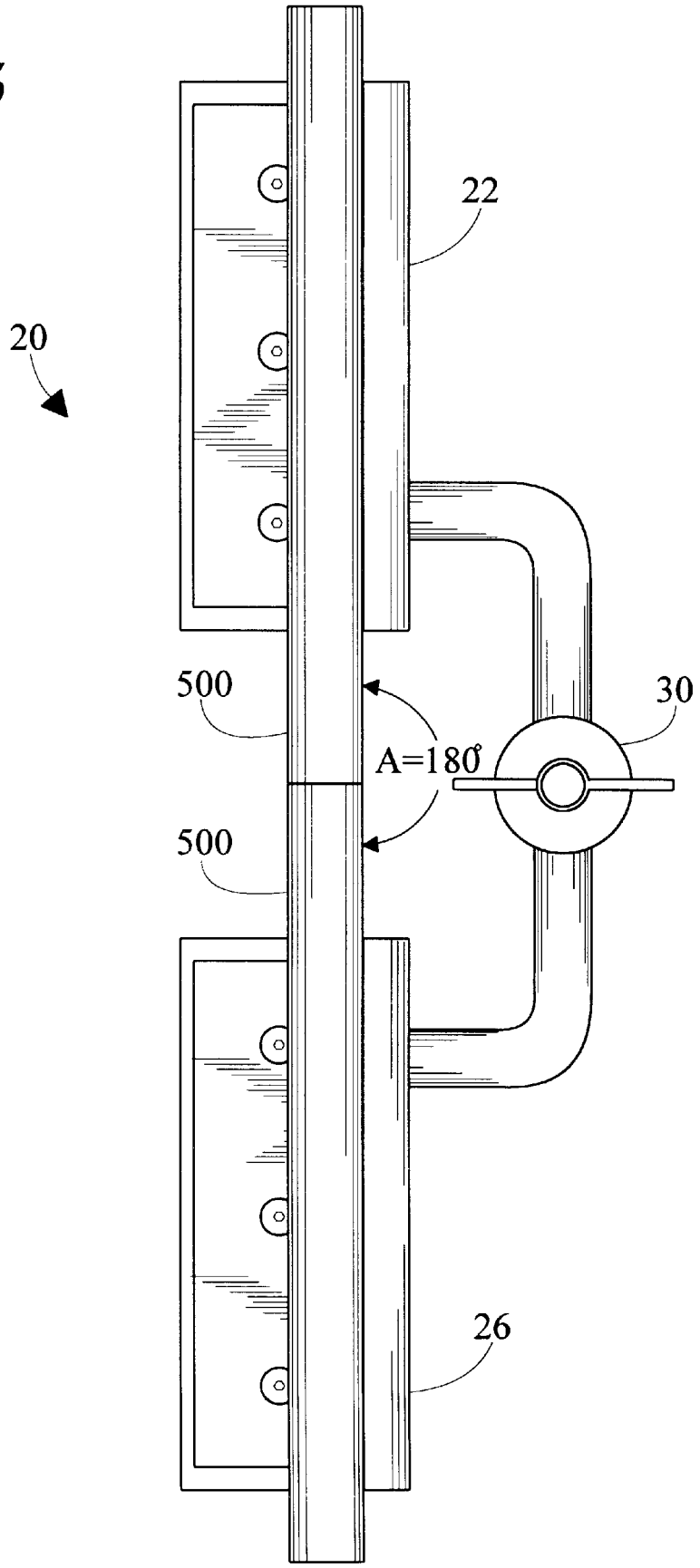
FIG. 13 is a top plan view of the jig being used to hold two pipes in a 180° position.

FIG. 13 is a top plan view of jig 20 being used to hold two pipes 500 in an aligned 180° position. It is important to note that in this position of the present invention, the pipe workpieces can be rotated as a welding operation proceeds, with the welding apparatus remaining stationary. This is in contrast to conventional welding jigs wherein the welding apparatus must be rotated around the welded joint.

Adjustable magnetic jig 20 is used for holding two magnetic workpieces 500 in a desired physical relationship so that the two workpieces 500 can be welded together. To accomplish this, pivoting joint 30 is adjusted to form a desired angle A. The pivoting joint 30 is then locked at the desired angle A. The first workpiece 500 is then placed in the first magnetic holder 22 so that it abuts both first planar surface 40 and second planar surface 42, and the second workpiece 500 is placed in the second magnetic holder 26 so that it abuts both first planar surface 40 and second planar surface 42. In that the workpieces 500 are made of magnetic material, they are held in place against the planar surfaces of magnetic holders 22 and 26. The two workpieces 500 are then arranged by the user in a ready-for-weld position.

In a preferred embodiment magnets 70 are ceramic permanent magnets, and the holders 22 and 26, elbows 32 and 34, and pivoting joint 30 are fabricated from cold-rolled steel which is plated with copper to act as a barrier against weld splatter.

The preferred embodiments of the invention described herein are exemplary and numerous modifications, dimensional variations, and rearrangements can be readily envisioned to achieve an equivalent result, all of which are intended to be embraced within the scope of the appended claims.

I claim:

1. An adjustable magnetic jig, comprising:

a first magnetic holder having a first longitudinal axis;

a second magnetic holder having a second longitudinal axis, said second longitudinal axis coplanar with and intersecting said first longitudinal axis to form an angle therebetween;

a pivoting joint connecting said first and second magnetic holders, so that said angle may be selectively adjusted;

said first and second magnetic holders each further including at least one magnet;

said first and second magnetic holders each further including first and second walls which intersect at a substantially 90° angle forming first and second substantially perpendicular planar surfaces, the intersection of said surfaces defining said first longitudinal axis for said first magnetic holder, and defining said second longitudinal axis for said second magnetic holder;

said first wall further including a first magnet-receiving cavity, and said second wall further including a second magnet-receiving cavity; and, a removable cover covering both said first and second magnet receiving cavities.

2. An adjustable magnetic jig, comprising:

a first magnetic holder having a first longitudinal axis;

a second magnetic holder having a second longitudinal axis, said second longitudinal axis coplanar with and intersecting said first longitudinal axis to form an angle therebetween;

a pivoting joint connecting said first and second magnetic holders, so that said angle may be selectively adjusted;

said first and second magnetic holders each further including at least one magnet;

said first and second magnetic holders each further including first and second walls which intersect at a substantially 90° angle forming first and second substantially perpendicular planar surfaces, the intersection of said surfaces defining said first longitudinal axis for said first magnetic holder, and defining said second longitudinal axis for said second magnetic holder; and, said first and second magnetic holders being substantially channel-shaped.

3. An adjustable magnetic jig according to claim 1, said pivoting joint further having first and second rotary members, said first rotary member connected to said first magnetic holder, and said second rotary member connected to said second magnetic holder, said first and second rotary members rotatable with respect to each other.

4. An adjustable magnetic jig for first and second workpieces, comprising:

a first magnetic holder having a first longitudinal axis;

a second magnetic holder having a second longitudinal axis, said second longitudinal axis coplanar with and intersecting said first longitudinal axis to form an angle therebetween;

a pivoting joint connecting said first and second magnetic holders, so that said angle may be selectively adjusted;

said first and second magnetic holders each further including at least one magnet;

said first and second magnetic holders each further including first and second walls which intersect at a substantially 90° angle forming first and second substantially perpendicular planar surfaces, the intersection of said surfaces defining said first longitudinal axis for said first magnetic holder, and defining said second longitudinal axis for said second magnetic holder; and, the first workpiece abutting said first and second planar surfaces of said first magnetic holder, and the second workpiece abutting said first and second planar surfaces of said second magnetic holder.

5. An adjustable magnetic jig according to claim 1, further including a magnetic workpiece placed in said first magnetic holder so that the workpiece abuts both said first planar surface and said second planar surface.

6. An adjustable magnetic jig according to claim 1, said first wall further including a first magnet-receiving cavity, and said second wall further including a second magnet-receiving cavity.

7. An adjustable magnetic jig according to claim 1, wherein said pivoting joint is selectively lockable so that said angle can be fixedly maintained.

8. An adjustable magnetic jig, comprising:

a first magnetic holder having a first longitudinal axis;

a second magnetic holder having a second longitudinal axis, said second longitudinal axis coplanar with and intersecting said first longitudinal axis to form an angle therebetween;

a pivoting joint connecting said first and second magnetic holders, so that said angle may be selectively adjusted;

said first and second magnetic holders each further including at least one magnet;

said first and second magnetic holders each further including first and second walls which intersect at a substantially 90° angle forming first and second substantially perpendicular planar surfaces, the intersection of said surfaces defining said first longitudinal axis for said first magnetic holder, and defining said second longitudinal axis for said second magnetic holder;

said first wall further including a first magnet receiving cavity, and said second wall further including a second magnet receiving cavity;

a removable cover which covers both said first and second magnet receiving cavities;

said pivoting joint further having first and second rotary members, said first rotary member connected to said first magnetic holder, and said second rotary member connected to said second magnetic holder, said first and second rotary members rotatable with respect to each other;

said first rotary member including angular indicia, and said second rotary member including an index mark; and, said pivoting joint selectively lockable so that said angle can be fixedly maintained.

9. An adjustable magnetic jig according to claim 6, wherein said first and second rotary members can be angularly positioned so that said angle is between substantially 45° and 180°.

10. An adjustable magnetic jig according to claim 7, wherein said first rotary member includes one of angular indicia and an index mark, and said second rotary member includes the other of angular indicia and an index mark.

* * * * *